United States Patent [19]

Wiersema et al.

[11] Patent Number: 4,550,893

[45] Date of Patent: Nov. 5, 1985

[54] HANGER CLIP FOR RETAINING A COMPONENT TO A SLOTTED UPRIGHT

[75] Inventors: Delbert Wiersema, Zeeland; John A. Szmadzinski, Grand Rapids, both of Mich.

[73] Assignee: Herman Miller, Inc., Zeeland, Mich.

[21] Appl. No.: 373,425

[22] Filed: Apr. 30, 1982

[51] Int. Cl.[4] ..... A47G 55/00

[52] U.S. Cl. ..... 248/222.4; 248/243; 211/103

[58] Field of Search ..... 248/222.4, 221.3, 222.1, 248/243, 224.4, 225.2; 211/192, 103, 207, 208; 312/245; 52/36

[56] References Cited

U.S. PATENT DOCUMENTS

| | | | |
|---|---|---|---|
| 1,722,529 | 7/1929 | MacDonald | 248/222.4 |
| 3,299,839 | 1/1967 | Nordbak | 248/243 X |
| 3,601,432 | 8/1971 | Fenwick | 287/189 |
| 3,612,290 | 10/1971 | Evans | 211/192 |
| 3,759,297 | 9/1973 | Anderson et al. | 248/243 X |
| 3,794,281 | 2/1974 | Munsey | 248/188 |
| 3,886,698 | 6/1975 | Raith et al. | 211/87 X |
| 3,888,440 | 6/1975 | Rebentisch | 248/73 |
| 4,013,254 | 3/1977 | Boundy et al. | 248/243 |
| 4,048,768 | 9/1977 | Good | 52/36 |
| 4,074,812 | 2/1978 | Skubic et al. | 211/192 |
| 4,129,279 | 12/1978 | Burkholder | 248/165 |
| 4,148,106 | 4/1979 | Gallien | 5/296 |
| 4,171,789 | 10/1979 | Vander Hoek et al. | 248/243 |
| 4,205,815 | 6/1980 | Sauer et al. | 248/222.1 X |
| 4,222,542 | 9/1980 | Wilson et al. | 248/243 |
| 4,401,222 | 8/1983 | Kalikowski et al. | 211/103 X |

FOREIGN PATENT DOCUMENTS

| | | | |
|---|---|---|---|
| 557722 | 6/1957 | Belgium | 248/222.2 |

*Primary Examiner*—Ramon S. Britts
*Assistant Examiner*—Sarah A. Lechok
*Attorney, Agent, or Firm*—Varnum, Riddering, Schmidt & Howlett

[57] ABSTRACT

A hanger clip (30) for retaining a hanging component (20, 22) to a slotted upright (26) has a generally V-shaped configuration with a plurality of vertically spaced hooks (32, 34, 35) projecting from a rear web (**36*b*) of the clip (30) adapted for engagement with a plurality of slots (27) in the upright (26). The clip (30) includes a biasing means (38, 48) for biasing the plurality of hooks (32, 34, 35) into the slots (27) of the upright (26). The clip (30) may include either a plurality of J-shaped hooks (34) or a spring clip (50) with a locking tab (52) which upon engagement with the slotted upright (26) prevent upward movement of the clip (30) with respect to the upright (26**).

The clip (30) can be directly secured to a component (20, 22) by fastening a front web (**36*a*) of the clip (30) to an end panel (24 or 24*a*) of the component (20, 22) with conventional fasteners. Alternatively, the end panel (24 or 24*a*) of a component (20, 22) can be releasably engaged with the hanger clip (30) by screws (25) attached to the end panel (24 or 24*a*) which are received in an aperture (42) and a plurality of keyholes (40, 41) on the front web (36*a*) of the clip (30). One screw (25) placed in the aperture (42) is retained by a resilient retainer tab (46) which is selectively placed relative to the aperture (42) so as to prevent upward movement of the screw (25) inserted therein. Accordingly, the tab (46) prevents accidental dislodgment of the end panel (24 or 24*a*) and the screws (25) attached thereto from the clip (30**).

16 Claims, 10 Drawing Figures

HANGER CLIP FOR RETAINING A COMPONENT TO A SLOTTED UPRIGHT

DESCRIPTION

TECHNICAL FIELD

The invention relates to a hanger clip for supporting a hanging component on a slotted upright and for preventing upward movement and dislodgment of the component with respect to the upright.

BACKGROUND ART

Conventional attachment of a hanging component, such as a cabinet, storage shelf or freestanding panel is accomplished by utilizing a hanger clip. Typically, the clip includes a plurality of vertically spaced, rearwardly projecting hooks which are adaptable for engagement with a slotted upright connected to the wall or panel.

In an attempt to eliminate the possibility of accidental dislodgment, prior known clips or similar mounting apparatus have included a locking mechanism for securing the clip to the slotted upright and the hanging component. For example, U.S. Pat. No. 4,222,542, issued Sept. 16, 1980, discloses a clip with a locking member including an integral, elongate cantilevered spring arm which urges a rearwardly projecting locking tab to be disposed below a downwardly facing surface in one of the slots in a slotted upright panel. Once in position, the locking member prevents upward movement of the L-shaped hooks within the vertically spaced slots of the panel.

U.S. Pat. No. 4,048,768, issued Sept. 20, 1977, discloses a bracket for lockably securing a hanging component to a decorative wall. The bracket includes a pivotal safety lock which includes an arm which can be inserted into a slotted upright. In this way, the engagement of the bracket with the slotted upright is maintained when the lock is affixed in place.

U.S. Pat. No. 3,794,281, issued Feb. 26, 1974, discloses a clip having a plurality of T-shaped tabs extending from the clip so as to engage a plurality of slots in a panel. The T-shaped connectors are locked into place in the slots by a latch mechanism having a finger detent. The latch mechanism is inserted through one of the slots and is adapted to engage the back side of the wall of the slotted strip.

DISCLOSURE OF THE INVENTION

In accordance with the invention, a hanger clip for releasably securing a component to a slotted upright includes a front and rear web and a plurality of hooks outwardly projecting from the rear web adapted for engagement with a rear wall of the slotted upright. The clip is provided with biasing means which prevents dislodgment of the hooks from the upright by urging the plurality of hooks against the rear wall of the upright. When a downwardly directed, J-shaped hook is used in conjunction with biasing means, upward movement of the clip is prevented.

One type of biasing means includes a resilient pad connected to an inner wall of the front web of the clip. Another embodiment includes a lever mechanism connected to the front web of the clip and which is pivotable so as to wedge between the clip and the slotted upright, the lever forcing the clip and upright apart and, accordingly, forcing the hooks against an inner side of the upright.

In another embodiment of the hanger clip, a spring clip with a locking tab is connected to the front web of the hanger clip and bears against an exterior wall of the upright. The locking tab is adaptable to engage a slot of the upright so as to prevent upward movement of the clip with respect to the upright and, accordingly, prevent accidental dislodgment of the clip therefrom.

All of the embodiments of the hanger clip discussed above can be directly fastened with a conventional fastener or pin which is secured to an end panel of a component or, alternatively, the end panel can be releasably engaged with the clip by inserting the conventional fasteners attached to the end panel into at least one aperture on the front web of the clip. To retain the fastener in the at least one aperture, a retainer tab is provided on the clip. The tab is placed relative to the aperture so as to interfere with the removal of the fastener in the aperture. Further, the retainer tab is resilient so that when a fastener is pressed against it, the tab will flex to either side relative to the aperture, enabling the fastener to be inserted therein. Thereafter, the tab will be positioned so as to prevent dislodgment of the fastener and component attached thereto from the clip.

To accomodate releasable engagement of a component with the hanger clip, the front web of the clip is provided with at least one hole which is adapted to receive a conventional fastener or pin. Positioned relative to the at least one hole is a stop member, such as a boss or a screw, which enables the fastener to be aligned with the hole when it is desired to remove the fastener from the clip.

Accordingly, the hanger clip is engaged by or secured to an end panel of a component, enabling a component to be releasably secured to a slotted upright. The hanger clip is first secured to a slotted upright with the component subsequently engaged therewith or, alternatively, the hanger clip is first affixed to the end panel and the hanger clip connected to the slotted upright thereafter. The apertures, holes and retainer tab of the clip are utilized in conjunction with the fasteners of the end panel to prevent accidental dislodgment of the end panel from the hanger clip. The J-hooks in conjunction with the biasing means or spring clip with the locking tab prevent upward movement of the clip with respect to the upright and, accordingly, prevent accidental dislodgment of the clip therefrom. Further, the resilient pad or the lever mechanism used in conjunction with the plurality of hooks releasably secure the hanger clip to the slotted upright by urging and releasably securing the hooks in engagement with the slotted upright, thereby preventing accidental dislodgment of the hanger clip from the upright.

BRIEF DESCRIPTION OF DRAWINGS

The invention will now be described with reference to the accompanying drawings in which:

FIG. 3 is a rear view of the hanger clip shown in FIG. 2;

BEST MODE FOR CARRYING OUT THE INVENTION

Figure 1:
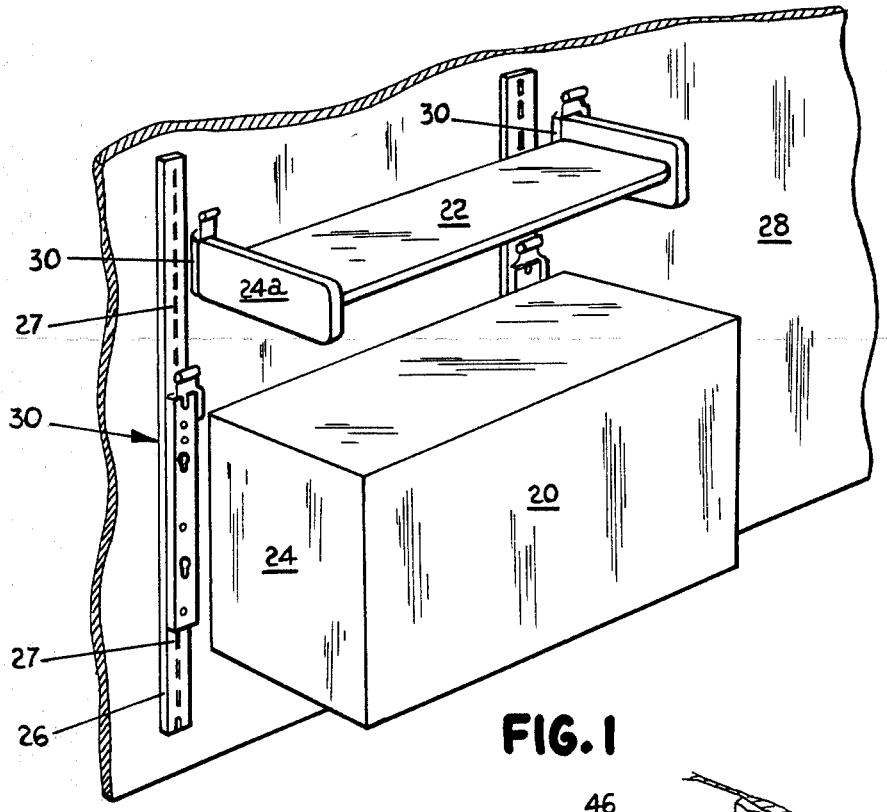
FIG. 1 is an exploded perspective view of hanger clips mounting a cabinet and a shelf to a slotted upright on a wall panel in accordance with the invention.

Referring to FIG. 1, a file cabinet 20 and a shelf 22 are each connected to a slotted upright 26 mounted to a wall panel 28 by a hanger clip 30. Alternatively, the upright 26 could form part of a freestanding divider panel. More particularly, the side or end panels 24, 24*a* of the cabinet 20 and shelf 22, respectively, are fastened to the hanger clip 30 which enables one to select a desired height at which the cabinet 20 and shelf 22 can be fastened to the slotted upright 26. The upright 26 has a surface which is pitched at an acute angle to the surface of wall panel 28 and which includes a plurality of vertically spaced slots 27, each having a top edge 27*a* defined by the slot. The upright 26 includes a rear wall 26*a* defined by the interior side of the upright 26 between slots 27. While FIG. 1 illustrates the mounting of a cabinet 20 and shelf 22, it can be appreciated that numerous other types of storage components such as bookshelves and lateral files can also be mounted thereon.

The basic form of the upright 26 and the clip 30 are shown in U.S. Pat. No. 3,430,997, issued Mar. 4, 1969, which patent is incorporated herein by reference.

Figure 2:
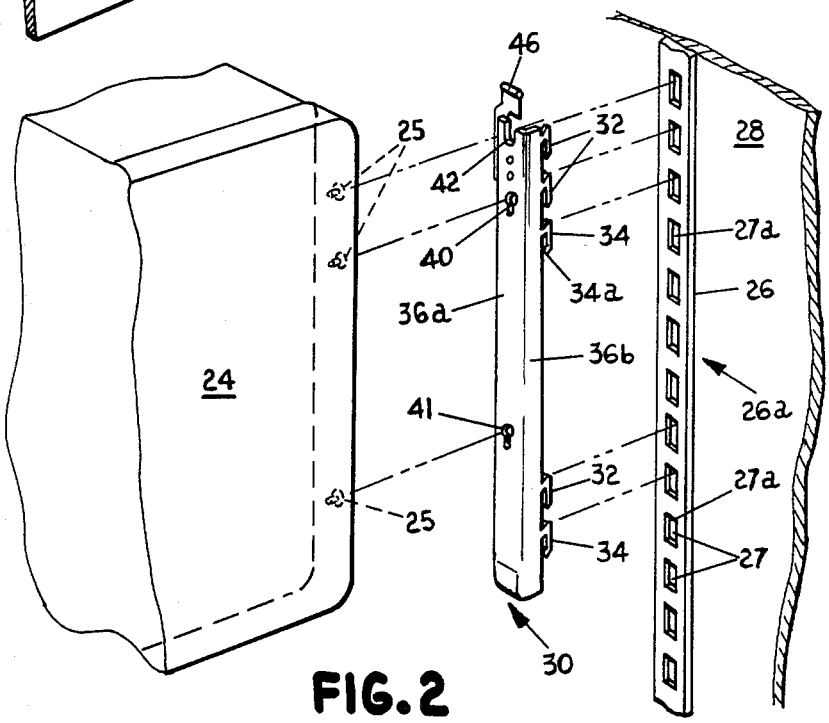
Figure 3:
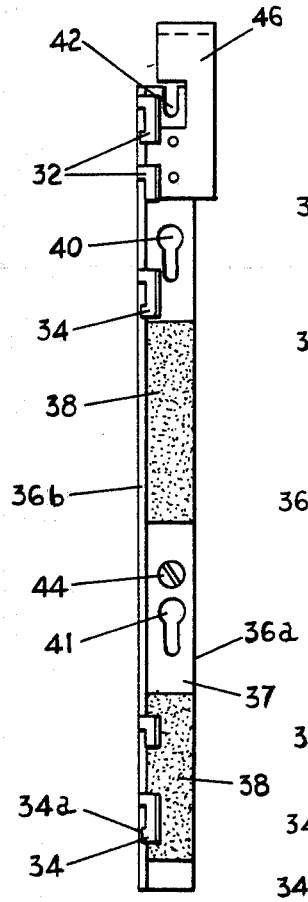
FIG. 3 is an exploded perspective view of a first embodiment of the hanger clip of FIG. 1.
Figure 5:
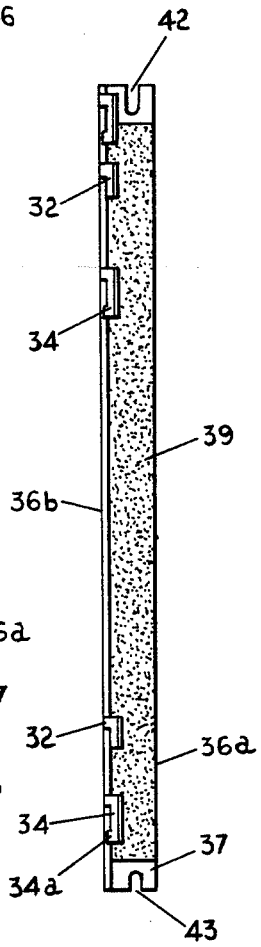
FIG. 5 is a rear view of a second embodiment of the hanger clip.
Figure 4:
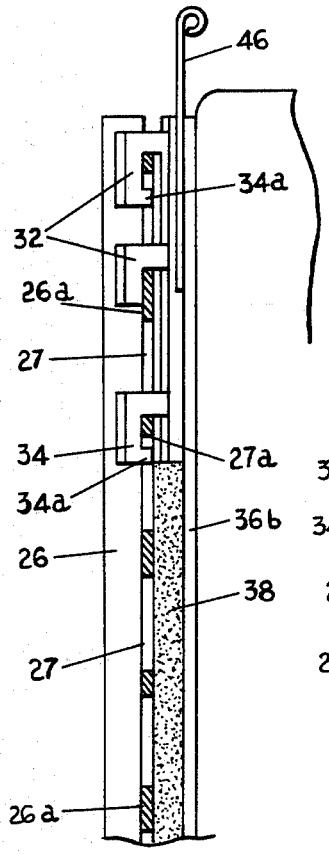
FIG. 4 is an enlarged fragmentary view of the hanger clip shown in FIG. 3 in engagement with the slotted upright.

A first embodiment of the hanger clip 30 is shown in FIGS. 2, 3 and 4. The clip 30 has a generally V-shaped configuration having a front web 36*a* and a rear web 36*b*. A plurality of vertically spaced, downwardly directed L-shaped hooks 32 and a plurality of vertically spaced, downwardly directed J-shaped hooks 34 extend from the rear web 36*b*. the J-shaped hooks 34 have a downwardly-extending flange adapted to engage the interior side of upright 26 and an outwardly directed projection 34*a* which fits within a slot 27 just beneath the top edge 27*a* thereof. On an inner wall 37 of the front web 36*a*, as best seen in FIG. 3, are a plurality of resilient pads 38, preferably made of foam rubber. The pads 38 bias the hooks 32, 34 against the slotted upright 26 so as to lock the clip 30 in place as described herein. The pads 38 are adhered to the inner wall 37 of the front web 36*a* of the bracket 36 with conventional fastening means such as an adhesive.

The front web 36*a* has a plurality of keyholes 40, 41 centrally located thereon and a downwardly extending aperture 42 located on the top of the front web 36*a*. The clip 30 is fastened to a storage component by a plurality of fasteners or pin members such as shoulder screws 25 which are secured to the end panel 24*a* of a component and received in the keyholes 40, 41 and aperture 42. Above the lower keyhole 41, as depicted in FIG. 3, is a conventional screw 44 fixed to the inner wall 37 of the front web 36*a* which serves as a stop member to provide a means for conveniently aligning one shoulder screw 25 fastened to the end panel 24*a* of a component with the keyholes 40, 41 when disassembly of the component is desired as further described herein. Although depicted above the lower keyhole 41, the screw 44 may be positioned above any one keyhole 40 or 41 on the front web 36*a*. A resilient retainer tab 46, located at the top of the front web 36*a*, extends over and inwardly from the downwardly extending aperture 42, thereby acting as a latch for a shoulder screw 25 once inserted in the aperture 42 as described herein. The retainer tab 46 can be fixed or pivoted into position as desired.

The size of the clip 30 and the spacing between the hooks 32, 34, keyholes 40, 41 and aperture 42 are determined by the spacing between the slots 27 on the upright 26 and the shoulder screws 25 of the end panels 24 or 24*a*. As can be seen, a larger clip 30 is necessary to secure and retain a component having a large end panel or a cabinet 20 to the slotted upright 26.

In use, the hanger clip 30 can either be directly fastened or connected to a component and then lockably mounted on the slotted upright 26 or lockably mounted on the slotted upright 26 followed by engagement of the component with the clip 30. In the system shown in the drawings using V-shaped clips, it is preferable to first mount the clips 30 to the shelf end panels 24*a* and then mount the clip 30 and end panels 24*a* to the uprights 26. Thereafter the shelves 22 are mounted to the end panels 24*a*. On the other hand, the cabinets 20 are assembled before they are mounted to the uprights 26. Thus, the clips 30 are first mounted to the vertical upright 26 and the cabinets 20 are then hung onto the clips 30. It is within the scope of the invention to use L-shaped clips instead of V-shaped clips and to use any order for mounting the clips 30 to the uprights 26, the end panels 24 and the cabinets 20.

In order to lockably mount the hanger clip 30 with the slotted upright 26, the plurality of L-shaped and J-shaped hooks 32, 34 must first be projected through the vertically spaced slots 27 of the upright 26 so as to compress the resilient pad 38 against the slotted upright 26. Thereafter, the hanger clip 30 is slid downwardly until the plurality of hooks 32, 34 engage the top edge 27*a* of the slots 27 of the upright 26. The resilient pad 38 will bias an outwardly directed projection 34*a* of the J-hook 34 up under the top edge 27*a* of the respective slot 27 of the upright 26 and against the rear wall 26*a* of the upright 26 as shown in FIG. 4. Accordingly, the resilient pad 38 lockably mounts the hooks 32, 34 to the upright 26 and prevents unintended disengagement of the hooks 32, 34 from the upright 26 in that the pad 38 in combination with the J-shaped hooks 34 prevent upward movement and accidental dislodgment of the clip 30 from the upright 26. To remove the clip 30 from the upright 26, the pad 38 is compressed to disengage the projection 34*a* from the top edge 27*a* of slot 27 so that the hooks 32, 34 can move upwardly and then outwardly from the slots 27 of the upright 26.

To releasably mount a component to the hanger clip 30, the shoulder screws 25 which are affixed on the edge of the end panel 24 or 24*a* of the component are simultaneously aligned and inserted into the keyholes 40, 41 and aperture 42. The top shoulder screw 25 will flex or depress the resilient retainer tab 46 rearwardly away from of the aperture 42 during installation, enabling the screw 25 to be inserted therein. When the clip 30 is slid downwardly to secure the screws 25 in the keyholes 40, 41, the tab 46 will resiliently return to its original position to capture the screw 25 in the aperture 42 by acting as a latch or interference to prevent upward movement and dislodgment of the screw 25 and component there attached. The remaining shoulder screws 25 are likewise retained in their respective keyholes 40, 41 as a result of the retainer tab 46 retaining the top screw 25 in the aperture 42 which prevents upward movement of the clip 20 relative to the aperture 42. Accordingly, the tab 46 prevents upward movement and accidental dislodgment of the end panel 24 or **24*a* of a component from the clip 30. When it is desired to disengage the component from the hanger clip 30, the retainer tab 46 must be rearwardly flexed or depressed and the component upwardly moved until the lower shoulder screw 25 abuts the stop member 44 positioned above the lower keyhole 41, thereby aligning all the shoulder screws 25 for removal from the keyholes 40, 41 and aperture 42 in the hanger clip 30**.

The hanger clip 30 shown in FIGS. 1, 2, 3 and 4 can be directly connected to an end panel 24 or **24*a* with a conventional fastener thereby eliminating the need for the retainer tab 46, the keyholes 40, 41 and the stop member or screw 44. Such embodiments are shown in FIGS. 5–9 wherein the shoulder screws 25 are inserted through the top aperture 42 and a bottom aperture 43 on the front web 36*a* of the clip 30 so as to secure the clip 30 to the end panel 24*a*. In a second embodiment shown in FIG. 5, a one-piece resilient pad 39 extending from the top of the clip 30 to the bottom can be used in place of the plurality of pads 38 of the first-described embodiment, since the keyholes 40 and stop member 44, centrally positioned on the clip 30 as seen in FIG. 3, are not needed for the engagement of the panel 24**.

Figure 6:
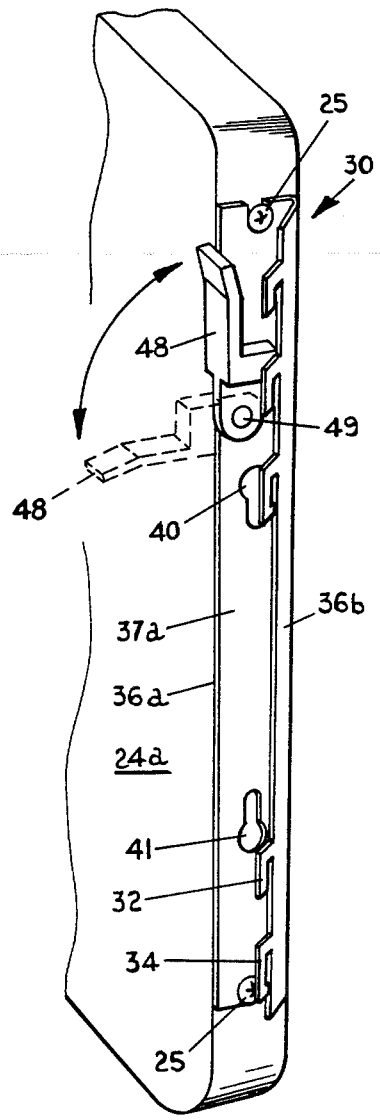
FIG. 6 is a rear perspective view of the third embodiment of a hanger clip connected to a shelf panel, the clip having a lever mechanism in accordance with the invention.
Figure 7:
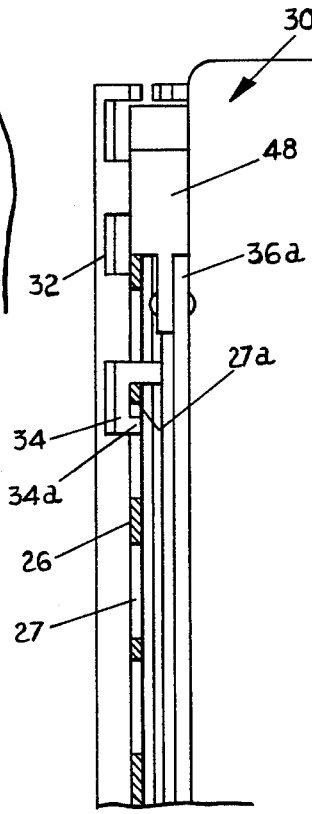
FIG. 7 is an enlarged fragmentary view of the hanger clip in FIG. 6 in engagement with the slotted upright.

A third embodiment of a hanger clip 30 is shown in FIGS. 6 and 7 wherein the hanger clip 30 is directly fastened to the end panel **24*a* of a component. In this embodiment, the clip 30 has a plurality of hooks 32, 34 projecting from the rear wall 36*b* and several keyholes 40, 41 on the front web 36*a* as in the first embodiment depicted in FIGS. 1–4. A pivoting lever 48 preferably made of hard rubber or plastic, is connected to the rear wall 37 of the front web 36*a* of the clip 30 through a shaft 49. When the plurality of hooks 32, 34 are projected into the slots 27 of the upright 26 and downwardly moved, the lever 48 is pivoted about the shaft 49 upwardly so as to wedge between the rear wall 36*b* of the clip 30 and the upright 26. Accordingly, and as best seen in FIG. 7, the lever 48 retains the hanger clip 30 on the upright 26, as the resilient pad 38 or 39 does by biasing the plurality of hooks 32, 34 against the rear wall 26*a* of the slotted upright 26 with the projection 34*a* seated beneath the top edge 27*a* of slot 27. To disengage the clip 30 from the upright 26, the lever 48 is pivoted downwardly, enabling the hooks 32, 34 to be moved upwardly and out of engagement with the slots 27**.

Figure 8:
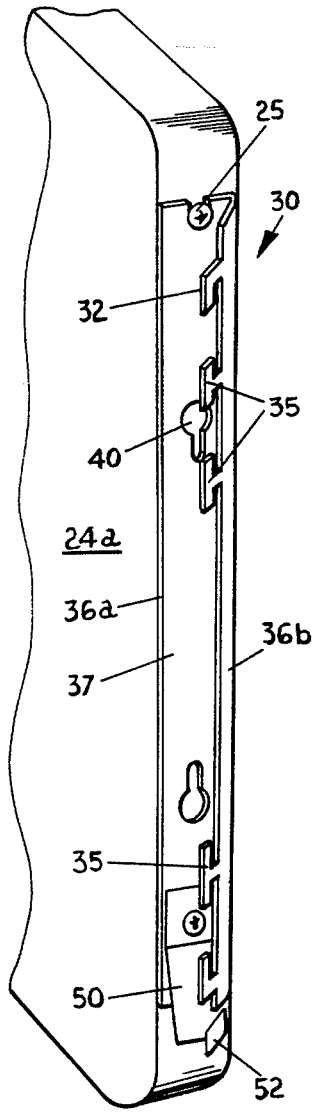
FIG. 8 is a rear perspective view of a fourth embodiment of a hanger clip.
Figure 9:
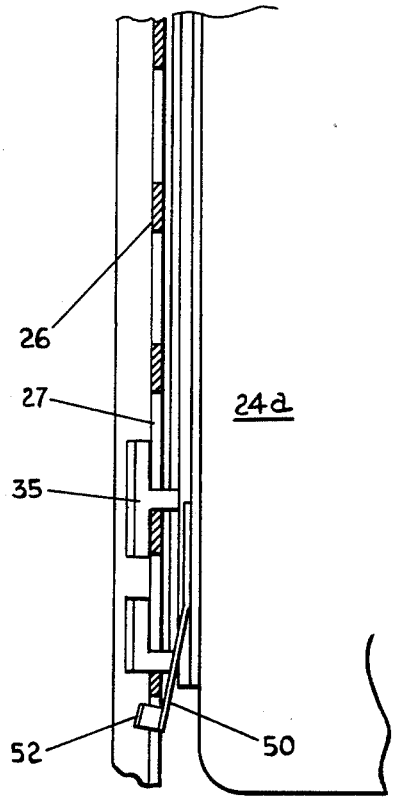
FIG. 9 is an enlarged fragmentary view of the hanger clip in FIG. 8 in engagement with the slotted upright.

Referring to FIGS. 8 and 9, a fourth embodiment of a hanger clip 30 is shown. In this embodiment, the clip 30 has a plurality of L-shaped hooks 32 and several T-shaped hooks 35 or engagement with the slotted upright 26. A spring clip 50 with a lock tab 52 is secured to the clip 30 to bias the hanger clip 30 against the slotted upright 26. As depicted in FIG. 9, when the plurality of hooks 32, 35 are in engagement with the slotted upright 26, the lock tab 52 of the spring clip 50 projects into a slot 27 of the upright 26 and is maintained in position by the spring clip 50. Accordingly, once the lock tab 52 is in engagement against the inner wall **26*a* of the upright 26, upward movement and dislodgment of the clip 30 is prevented. When disengagement of clip 30 from the upright 26 is desired, the lock tab 52 is pulled back manually, disengaging the tab 52 from the slot 27 of the upright, thereby enabling the hooks 32, 35 to be moved upwardly and outwardly relative to the upright 26. As with the second and third embodiments previously discussed, the embodiment shown in FIGS. 8 and 9 is fastened to an end panel 24 or 24*a* and therefore the clip 30 does not require a retainer tab 46**.

Figure 10:
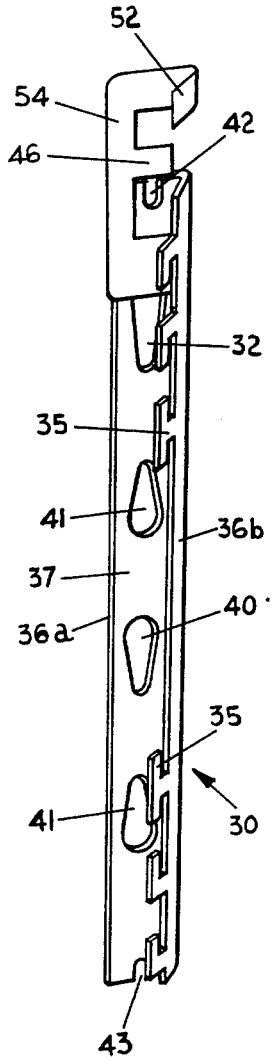
FIG. 10 is a rear perspective view of a fifth embodiment of the hanger clip.

Referring to FIG. 10 a fifth embodiment of a hanger clip 30 is shown. In this embodiment, the clip 30 is not directly fastened to an end panel 24 or **24*a*. The clip 30 has a unitary one-piece spring clip/lock tab/retainer tab 54 secured to the top of the rear web 36*b* of the clip 30 to prevent upward movement and dislodgment of the plurality of hooks 32, 35 of the clip 30 from the slotted upright 26 and of the screws 25 connected to end panel 24*a* from the keyholes 40, 41 of the clip 30. Although hooks 32 and 35 are shown in FIG. 10, hooks 34 can be used for engagement with the slotted upright 26 as well. Further, unlike the previously discussed embodiments, this hanger clip 30 has a plurality of bosses 45 positioned relative to the keyholes 40, 41 to serve as stop members in the fashion of the screw 44 shown in FIG. 3**.

Various other combinations of the particular features discussed above can be combined to make a hanger clip 30 which is able to be lockably mounted to a slotted upright 26 while being fastened to a hanging component. For instance, the hanger clips 30 shown in FIGS. 8 and 9 can include a plurality of hooks 32 and 34 or hooks 32 and 35, for mating with slots 27. Further, the clips 30 in FIGS. 1–10 can be provided with or without a retainer tab 46 depending upon whether the clip 30 is directly fastened to the end panel 24 or **24*a*. Lastly, any of the embodiments can include keyholes with or without stop members 44 or 45 as seen in FIG. 3 or 10** respectively.

Accordingly, the hanger clip 30 secures a component to the hanger clip 30 with the retainer tab 46 which prevents the accidental dislodgment of the shoulder screw 25 of the end panel 24 or **24*a* from the hanger clip 30. Further, the plurality of hooks 32, 34, 35 in conjunction with the locking tab 52 or the J-hooks 34 in conjunction with the pad 38, 39 or lever 48 will prevent upward movement of the clip 30 when the tab 52 or J-hooks 34, respectively, are engaged with the slotted upright 26. The resilient pad 38 or 39 or the lever mechanism 48 bias the plurality of hooks 32, 34 on the clip 30 against the slotted upright 26 so as to prevent accidental disengagement and lockably mount and retain the clip 30 to the slotted upright 26. Thus, the hanger clip 30 ensures that a component is properly secured to a wall or panel in a fashion which prevents upward movement and dislodgment of the component from the clip 30 and the clip 30** from the wall or panel.

The foregoing description and drawings are merely illustrative of the invention and are not intended to limit the invention to the above-described embodiments. Variations and changes which may be obvious to one skilled in the art may be made without departing from the scope and spirit of the invention which is defined in the appended claims.

The embodiments of the invention in which an exclusive property or privilege is claimed are defined as follows:

1. In a hanger clip for releasably securing a component to an upright including a plurality of vertically spaced slots in a wall having exterior and interior sides, said hanger clip having front and rear webs; hook means including depending flanges projecting outwardly from said rear web for receipt in said vertically spaced slots with said depending flanges adapted to abut the interior sides of said upright wall so as to mount said clip to said upright; and means adapted to connect said front web of said clip to said component;

the improvement which comprises:

biasing means acting between said clip and said upright for urging said hook means against said interior side of said upright;

said hook means including a projection on a bottom portion of said depending flange and extending at substantially right angles thereto in the direction of the interior wall of said upright, said hook means adapted to seat within a slot for preventing upward movement of said clip with respect to said upright;

whereby said biasing means prevents accidental dislodgement of said clip from said upright.

2. The hanger clip in accordance with claim 1 wherein said biasing means comprises a resilient pad secured to an inner wall of said front web of said clip so as to be positioned between said inner wall and said exterior wall of said upright.

3. The hanger clip in accordance with claims 1 or 2 wherein said connecting means comprises at least one aperture formed in said front web of said clip and said component includes fastening means for securing said component to said clip, whereby said fastening means is adapted to be releasably secured to said at least one aperture.

4. The hanger clip in accordance with claim 3 further comprising means for releasably retaining said fastening means in said at least one aperture, said retaining means including a retainer tab connected to said clip, said retainer tab being placed relative to said aperture so as to interfere with the removal of said fastening means from said aperture while enabling the fastening means to be inserted therein;

whereby said retainer tab is adapted to capture said fastening means in said aperture so as to prevent dislodgment of said fastening means from said aperture.

5. The hanger clip in accordance with claim 4 wherein said retainer tab is a resilient member which allows for flexible lateral movement of said retainer tab relative to said aperture so as to permit securing of said fastening means to said aperture.

6. The hanger clip in accordance with claim 3 wherein said connecting means further comprises:

at least one hole in said front web of said clip which is adapted to receive said fastening means; and a stop member on said inner wall of said front web selectively positioned relative to said at least one hole;

whereby said stop member enables said fastening means to be aligned with said hole for removal therefrom when said fastening means abuts said stop member.

7. The hanger clip in accordance with claim 6 wherein said stop member is a screw.

8. In a hanger clip for releasably securing a component to an upright having a plurality of vertically spaced apart slots and having exterior and interior walls, said hanger clip having front and rear webs; hook means projecting outwardly from said rear web of said clip for receipt in said vertically spaced slots; said hook means having a hooked portion abutting said interior wall of said upright when received in said slots so as to mount said clip to said upright; and fastening means adapted for securing said component to said front web of said clip so as to mount said component to said upright, said fastening means including an upwardly-opening aperture on said clip front web for receiving a slot-engaging pin having a head, the aperture being shaped to retain the head at one portion of said aperture and to permit passage of the head through another portion of said aperture;

the improvement which comprises:

releasable retaining means for preventing accidental disengagement of said pin from said another portion of said aperture.

9. The hanger clip in accordance with claim 8 wherein said releasable retaining means comprises a retainer tab connected to said clip, said retainer tab being placed relative to said aperture so as to interfere with the removal of said pin once inserted in said aperture while enabling the pin to be inserted therein;

whereby said retainer web is adapted to capture said pin in said aperture so as to prevent dislodgment of said pin from said aperture.

10. The hanger clip in accordance with claim 9 wherein said retainer tab is a resilient member which allows for flexible lateral movement of said retainer tab relative to said aperture to permit securing of said pin to said aperture.

11. The hanger clip in accordance with claim 6 wherein said clip comprises:

a stop member on an inner wall of said front web selectively positioned relative to said aperture;

whereby said stop member enables said fastening means to be aligned with said hole for removal therefrom when said fastening means abuts said stop member.

12. The hanger clip in accordance with claim 11 wherein said stop member is a boss.

13. The hanger clip in accordance with claim 11 wherein said stop member is a screw.

14. A hanger clip in accordance with claim 1 wherein said biasing means comprises a lever pivotally connected to said front web, said lever being adaptable to be wedged between said exterior wall of said upright and said front web when said hook means is received in said slots.

15. The hanger clip in accordance with claim 6 wherein said stop member is a boss.

16. The hanger clip in accordance with claim 9 wherein said retainer tab is pivotally connected to said clip.

* * * * *

UNITED STATES PATENT AND TRADEMARK OFFICE

CERTIFICATE OF CORRECTION

PATENT NO. : 4,550,893

DATED : November 5, 1985

INVENTOR(S) : DELBERT WIERSEMA and JOHN A. SZMADZINSKI

It is certified that error appears in the above-identified patent and that said Letters Patent are hereby corrected as shown below:

Column 2, line 60, "Figure 3" should read --Figure 2--.

Column 8, line 38, "claim 6" should read --claim 8--.

Signed and Sealed this

*Fifteenth* Day of *July 1986*

[SEAL]

*Attest:*

DONALD J. QUIGG

*Attesting Officer*

*Commissioner of Patents and Trademarks*